US007514858B2

(12) United States Patent
Yoo et al.

(10) Patent No.: US 7,514,858 B2
(45) Date of Patent: Apr. 7, 2009

(54) ELECTRON EMISSION DISPLAY DEVICE WITH ELECTRON COLLECTOR OR METAL MEMBER

(75) Inventors: Seung Joon Yoo, Suwon (KR); Jong Sick Choi, Suwon (KR); Zin Min Park, Cheonan (KR); Soo Joung Lee, Anyang (KR); Jung Ho Kang, Yongin (KR); Su Kyung Lee, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 482 days.

(21) Appl. No.: 11/291,101

(22) Filed: Nov. 29, 2005

(65) Prior Publication Data

US 2006/0138933 A1 Jun. 29, 2006

(30) Foreign Application Priority Data

Nov. 29, 2004 (KR) ..... 10-2004-0098908

(51) Int. Cl.

| | |
|---|---|
| ***G09G 3/22*** | (2006.01) |
| ***G09G 3/36*** | (2006.01) |
| ***H01J 63/04*** | (2006.01) |
| *H01K 1/62* | (2006.01) |
| *H01K 1/34* | (2006.01) |

(52) U.S. Cl. ..... 313/496; 313/497; 313/498

(58) Field of Classification Search ..... 313/495–498
See application file for complete search history.

(56) References Cited

U.S. PATENT DOCUMENTS 6,046,539 A * 4/2000 Haven et al. ..... 313/461
6,713,953 B1 * 3/2004 Sung et al. ..... 313/495
2003/0013372 A1 * 1/2003 Uemura et al. ..... 445/24
2004/0169458 A1 * 9/2004 Fran et al. ..... 313/495
2004/0174114 A1 * 9/2004 Ohishi et al. ..... 313/495
2004/0222734 A1 11/2004 Oh

FOREIGN PATENT DOCUMENTS

KR 2001-0075972 8/2001

* cited by examiner

*Primary Examiner*—Sikha Roy
*Assistant Examiner*—Tracie Y Green
(74) *Attorney, Agent, or Firm*—Christie, Parker & Hale, LLP

(57) ABSTRACT

An electron emission display comprising an electron collector or metal member is provided. The electron emission display comprises an electron emission substrate comprising at least one electron emission device and an image forming substrate comprising at least one emission region and at least one non-emission region. Images are formed in the emission regions by the collision of electrons emitted from the electron emission devices with the emission regions. The image forming substrate further comprises a metal layer positioned on at least the emission regions, and at least one electron collector positioned in the non-emission region. The electron collector may comprise first and second ends, wherein the first end is attached to the image forming substrate and the second end faces the electron emission substrate. The electron collector stabilizes the metal layer and fluorescent layers, thereby reducing arc and maintaining uniform brightness by re-directing scattered electrons toward the fluorescent layers.

25 Claims, 19 Drawing Sheets

ELECTRON EMISSION DISPLAY DEVICE WITH ELECTRON COLLECTOR OR METAL MEMBER

CROSS-REFERENCE TO RELATED APPLICATIONS

This application claims priority to and the benefit of Korean Patent Application No. 10-2004-0098908, filed Nov. 29, 2004 in the Korean Intellectual Property Office, the entire content of which is incorporated herein by reference.

FIELD OF THE INVENTION

The present invention relates to an electron emission display and, more particularly, to an electron emission display comprising at least one electron collector positioned in a non-emission region of an image forming substrate of the electron emission display. The electron collector scatters incident electrons in order to generate light uniformly in a pixel. The electron collector also stabilizes the structure between a metal layer and fluorescent layer on the image forming substrate.

BACKGROUND OF THE INVENTION

In general, electron emission displays use either hot cathodes or cold cathodes as electron sources. Electron emission displays using cold cathodes may be classified into field emitter array (FEA) types, surface conduction emitter (SCE) types, metal-insulator-metal (MIM) types, metal-insulator-semiconductor (MIS) types, ballistic electron surface emitting (BSE) types, and the like.

Electron emission devices are used to form electron emission displays, various backlights, electron beam apparatuses for lithography, and the like. A typical electron emission display comprises an electron emission substrate or first substrate, and an image forming substrate or second substrate. The electron emission substrate comprises a plurality of electron emission devices and control electrodes for controlling electron emission. The image forming substrate comprises fluorescent layers with which emitted electrons collide, thereby emitting light. The image forming substrate also comprises an electrode electrically connected to the fluorescent layers.

To improve brightness of the electron emission display, a reflective metal layer is positioned on the fluorescent layers. The metal layer directs the emitted electrons to the image forming substrate and attracts the electrons back to the fluorescent layer after they have been reflected toward the electron emission substrate by virtue of their collision with the fluorescent layers. Moreover, the metal layer prevents the remaining electrons from colliding with the fluorescent layers. Therefore, the metal layer can increase the life of the fluorescent layers and can prevent arc between the electron emission substrate and the image forming substrate. An exemplary method of fabricating such a metal layer for an electron emission display is disclosed in Korean Patent Laid-open Publication No. 2001-75972.

A method of fabricating a metal layer according to the prior art will now be described in conjunction with the accompanying drawings. FIGS. 1A through 1E are cross-sectional views of an image forming substrate according to the prior art. FIGS. 1A through 1E illustrate various steps in a prior art process for fabricating a metal layer for an electron emission display.

As shown in FIG. 1A, a metal layer is fabricated by first preparing a top layer 110. An anode electrode 120 is then formed on the top layer 110, and fluorescent layers 130 are formed on the anode electrode 120. Generally, the fluorescent layers 130 are formed in a matrix or striped pattern.

As shown in FIG. 1B, light-shielding layers 140 are formed on the anode electrode 120 in the spaces between the fluorescent layers 130. As shown in FIG. 1C, intermediate layers 150 are then formed on the fluorescent layers 130 by applying an acryl emulsion or lacquer solution to the fluorescent layers 130 and drying the solution. A metal layer 160 is then formed on the anode electrode 120, covering the intermediate layers 150, as shown in FIG. 1D. The intermediate layers 150 prevent irregular deposition of the metal layer 160 which can occur when the metal layer 160 is directly deposited on the rough surfaces of the fluorescent layers 130. By preventing uneven deposition of the metal layer 160 on the fluorescent layers 130, the intermediate layers 150 improve the reflection efficiency of the fluorescent layers 130.

Typically, the intermediate layers 150 each have a thickness of about 10 μm, and the intermediate layers 150 are removed after deposition of the metal layer 160. As a result, spaces are formed between the fluorescent layers 130 and the metal layer 160, as shown in FIG. 1E.

However, when the intermediate layers comprise an acryl component, it is difficult to adjust the spaces created between the fluorescent layers and the metal layer after removal of the intermediate layers. Moreover, these spaces between the fluorescent layers and the metal layer may cause arc on the metal layer when high exterior voltages are applied.

SUMMARY OF THE INVENTION

In one embodiment of the present invention, an electron emission display comprises an electron collector or metal member positioned on a non-emission region of an image forming substrate of the electron emission display. The electron collector or metal member protects the fluorescent layers from arc.

In another embodiment of the present invention, an electron emission display comprises an electron collector or metal member which extends from the surface of the image forming substrate toward the electron emission substrate of the electron emission display. The electron collector or metal member may comprise first and second ends wherein the first end is attached to the image forming substrate and the second end faces the electron emission substrate. In one embodiment, the second end of the electron collector or metal member has a width larger than a width of the first end. The electron collector or metal member collects the electrons emitted from the electron emission substrate and directs them to the fluorescent layers. The electron collector or metal member also collects irregularly emitted electrons that have been scattered by the fluorescent layers. The electron emission display according to this embodiment exhibits improved luminous efficiency.

In one exemplary embodiment of the present invention, an electron emission display comprises an electron emission substrate comprising at least one electron emission device and an image forming substrate facing the electron emission substrate and comprising at least one emission region and at least one non-emission region. Images are formed by the collision of electrons emitted from the electron emission devices with the emission regions of the image forming substrate. A metal layer is positioned on at least the emission regions of the second substrate. At least one electron collector or metal member is positioned on the at least one non-emission region. The electron collector or metal member extends a predetermined distance toward the electron emission substrate. The electron collector or metal member may comprise first and second ends, wherein the first end is attached to the image forming substrate and the second end faces the electron emission substrate. In one embodiment, the second end of the electron collector or metal member has a width larger than a width of the first end. The electron collector or metal member may comprise any suitable material, such as metal, and may comprise the same material as the metal layer.

In another exemplary embodiment of the present invention, an electron emission display comprises a first substrate or electron emission substrate comprising at least one electron emission device and a second substrate or image forming substrate facing the first substrate and comprising at least one emission region and at least one non-emission region. Images are formed by collision of electrons emitted from the electron emission devices with the emission regions of the second substrate. The image forming substrate may further comprise at least one light-shielding layer between the fluorescent layers. A metal layer is positioned on at least the emission regions of the second substrate. An electron collector or metal member comprising a metal sheet having at least one opening corresponding in position to the position of an emission region is deposited on the second substrate. The metal sheet may have a predetermined thickness, and the opening may be beveled such that a first region of the opening facing the electron emission substrate is larger than a second region of the opening facing the image forming substrate. The metal sheet may be a single or multi-layered sheet.

In addition, the metal layer may be formed on the entire surface of the image forming substrate, and the electron collector or metal member may be formed on the metal layer. The electron collector or metal member and metal layer may be energized by the same power source.

In one embodiment, the electron collector or metal member extends a predetermined distance of about 5 to about 200 μm from the image forming substrate toward the electron emission substrate.

The electron collector or metal member may comprise a reflective metal, and the metal layer may comprise aluminum. The electron collector or metal member may be adhered to the metal layer by an adhesive agent, such as frit.

BRIEF DESCRIPTION OF THE DRAWINGS

The above and other features and advantages of the present invention will become more apparent by reference to the following detailed description when considered in conjunction with the accompanying drawings, in which.

DETAILED DESCRIPTION

Figure 1A:
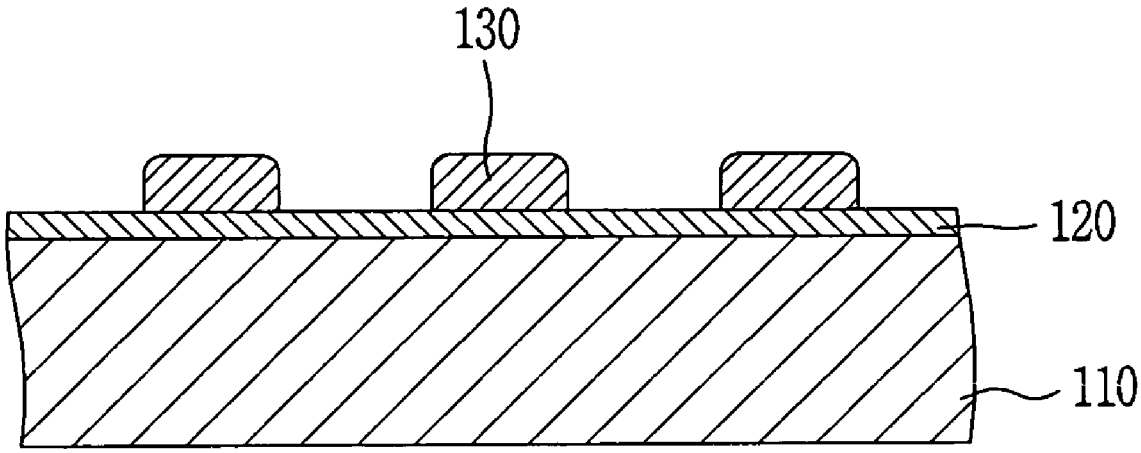
FIG. 1A (PRIOR ART)
FIG. 1A is a cross-sectional view of a representative portion of an image forming substrate of an electron emission device according to the prior art, illustrating a first step in a prior art process for depositing a metal layer.
Figure 1B:
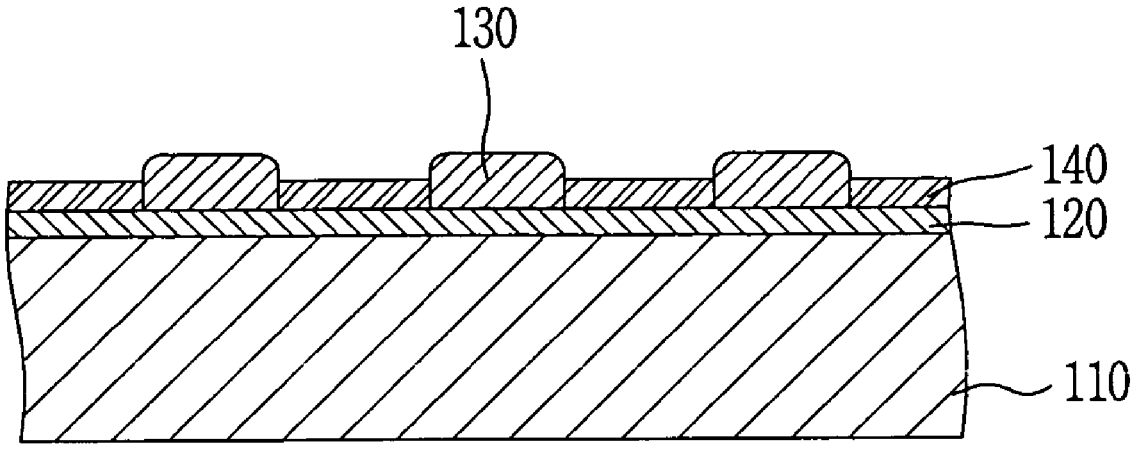
FIG. 1B (PRIOR ART)
FIG. 1B is a cross-sectional view of a representative portion of the image forming substrate of the electron emission device of FIG. 1A, illustrating a second step in a prior art process for depositing a metal layer.
Figure 1C:
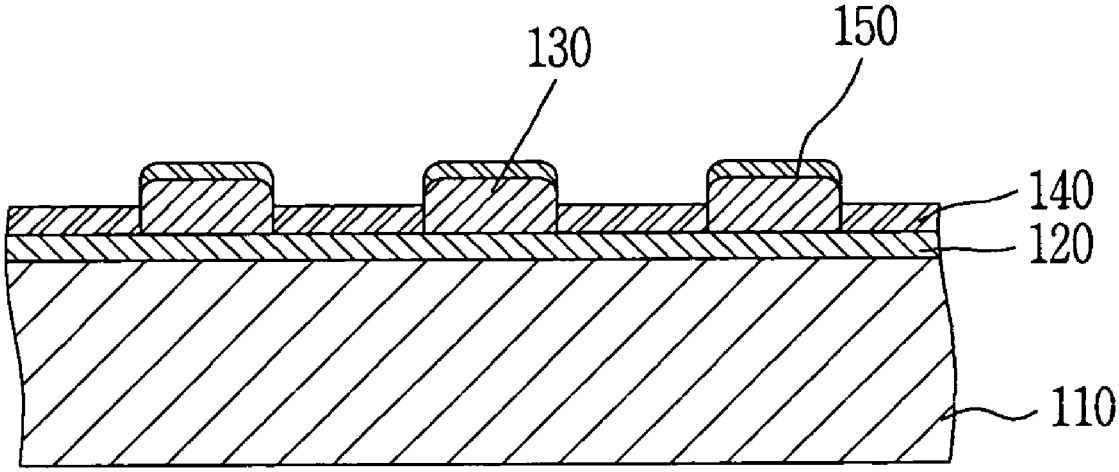
FIG. 1C (PRIOR ART)
FIG. 1C is a cross-sectional view of a representative portion of the image forming substrate of the electron emission device of FIG. 1B, illustrating a third step in a prior art process for depositing a metal layer.
Figure 1D:
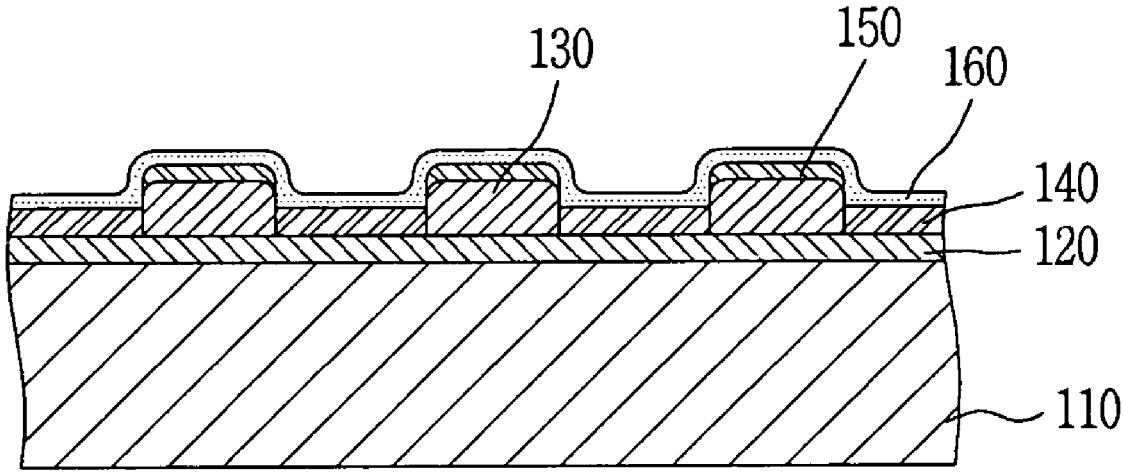
FIG. 1D (PRIOR ART)
FIG. 1D is a cross-sectional view of a representative portion of the image forming substrate of the electron emission device of FIG. 1C, illustrating a fourth step in a prior art process for depositing a metal layer.
Figure 1E:
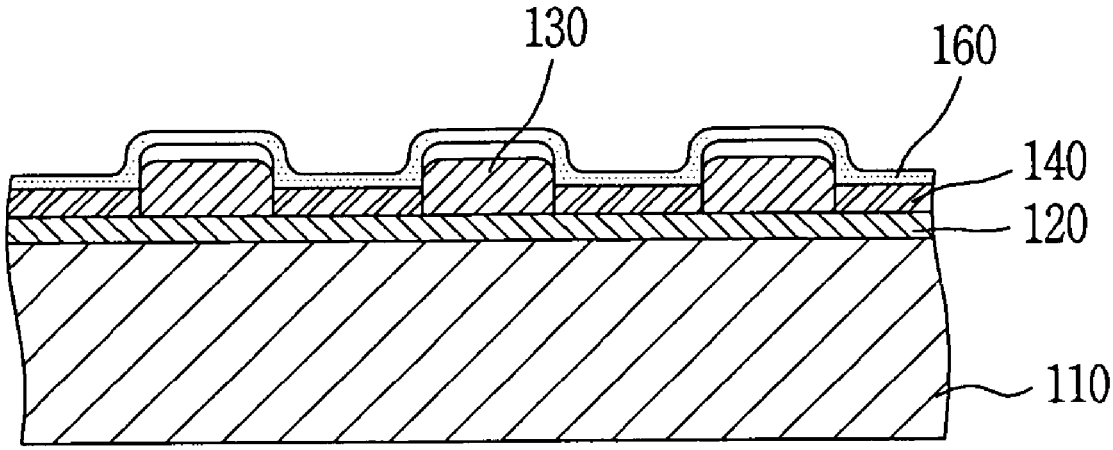
FIG. 1E (PRIOR ART)
FIG. 1E is a cross-sectional view of a representative portion of the image forming substrate of the electron emission device of FIG. 1D, illustrating a fifth step in a prior art process for depositing a metal layer.
Figure 2:
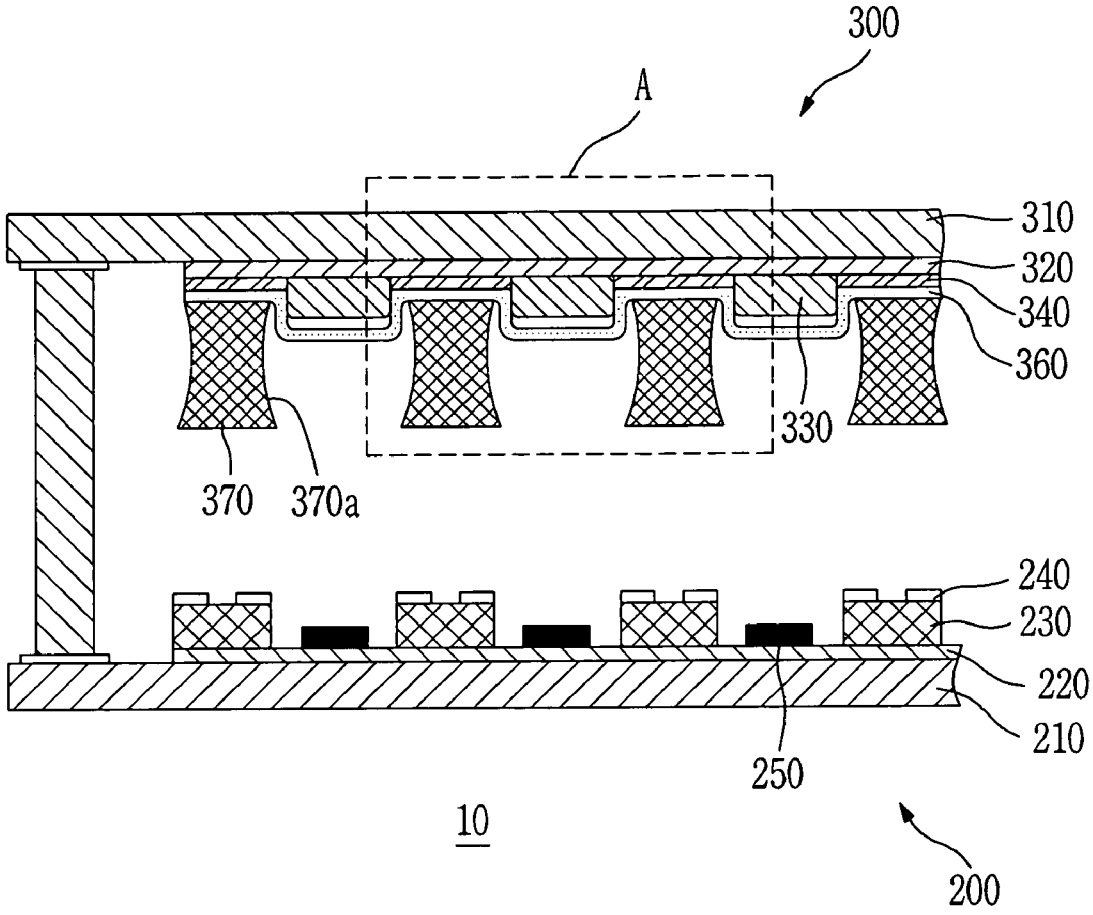
FIG. 2 is a cross-sectional view of an electron emission display according to one embodiment of the present invention.

Exemplary embodiments of the present invention will now be described with reference to FIGS. 2 through 4. FIG. 2 is a cross-sectional view of an electron emission display having at least one electron collector or metal member according to one embodiment of the present invention. Referring to FIG. 2, the electron emission display 10 comprises an electron emission substrate 200 and an image forming substrate 300 positioned facing the electron emission substrate 200.

The electron emission substrate 200 comprises a bottom layer 210 and at least one cathode electrode 220 positioned on the bottom layer 210 in a predetermined pattern, for example, a striped pattern. At least one gate electrode 240 is positioned on the bottom layer 210 in a direction substantially perpendicular to the cathode electrodes 220. At least one electron emission device 250 is also positioned on the bottom layer 210. Insulating layers 230 are positioned between the cathode electrodes 220 and the gate electrodes 240 to electrically insulate the cathode electrodes 220 from the gate electrodes 240. The electron emission devices 250 are positioned on the bottom layer 210 in a predetermined pattern, for example a matrix pattern, and are positioned on regions of the bottom layer where the cathode electrodes 220 and gate electrodes 240 intersect.

The bottom layer 210 may comprise any suitable material, for example, glass or silicon. The bottom layer 210 can be formed by a rear surface exposure method using carbon nanotube paste. When formed in this manner, the bottom layer 210 preferably comprises a transparent material such as glass.

The cathode electrodes 220 and gate electrodes 240 direct data signals and/or scan signals from data driving regions (not shown) and/or scan driving regions (not shown) to the electron emission devices 250. This drives the electron emission devices 250, which are positioned, for example, in a matrix pattern on the bottom layer 210 at the points of intersection of the cathode and gate electrodes 220 and 240, respectively. Driving of the electron emission devices 250 in this manner forms electric fields around the electron emission devices 250, causing the electron emission devices 250 to emit electrons.

The image forming substrate 300 is positioned facing the electron emission substrate 200, and comprises a top layer 310, an anode electrode 320 and at least one fluorescent layer 330. The image forming substrate 300 may also optionally comprise at least one light-shielding layer 340. In addition, the image forming substrate 300 further comprises at least one metal layer 360 formed on the fluorescent layer 330, and at least one electron collector or metal member 370 formed on the light-shielding layer 340. The top layer 310 of the image forming substrate 300 can comprise a transparent material.

The anode electrode 320 is positioned on the top layer 310 to accelerate electrons emitted from the electron emission devices 250 toward the fluorescent layers 330. The anode electrode 320 may comprise any suitable material, for example, indium tin oxide ("ITO") or indium-doped zinc oxide ("IZO"). However, because the metal layer 360 described below can perform the same function as the anode electrode 320, the anode electrode 320 may be omitted.

The fluorescent layers 330 are disposed on the anode electrode 320 in a predetermined pattern, for example a matrix or striped pattern. Light is emitted by the collision of electrons emitted by the electron emission devices 250 with the fluorescent layers 330. In one embodiment, the at least one fluorescent layer 330 comprises at least one red fluorescent layer (R), at least one green fluorescent layer (G), and at least one blue fluorescent layer (B).

When present, the light-shielding layers 340 are disposed on the image forming substrate 300 in the spaces between the fluorescent layers. The light-shielding layers 340 absorb and block external light and prevent optical crosstalk, thereby improving contrast. The light-shielding layers 340 may be disposed on the image forming substrate 300 in any desired pattern, for example in a matrix or striped pattern. In one embodiment, the pattern of the light-shielding layers 340 corresponds to the pattern of the fluorescent layers 330.

The fluorescent layers 330 and the light-shielding layers 340 may be positioned in various different patterns, and regions of the fluorescent layers 330 may overlap regions of the light-shielding layers 340. The image forming substrate 300 comprises at least one emission region where images are formed, and at least one non-emission region where no images are formed. In this embodiment, the emission regions are those areas on the image forming substrate where the fluorescent layers are positioned, and the non-emission regions are those areas on the image forming substrate where the fluorescent layers are not positioned.

The metal layer 360 is electrically connected to the fluorescent layers 330. As a result, the metal layer 360 can direct the electrons emitted from the electron emission devices 250 toward the fluorescent layers 330, and reflect the light emitted by the collision of the electrons with the fluorescent layers 330 toward the top layer 310 of the image forming substrate 300, thereby improving reflection efficiency. The metal layer 360 may comprise any suitable material, for example aluminum.

Each electron collector or metal member 370 is positioned on a non-emission region of the image forming substrate 300. The electron collector or metal member 370 may take any suitable shape, and positioning of the electron collector or metal member 370 will depend on the shape of the electron collector or metal member 370. In embodiments including light-shielding layers 340, each electron collector or metal member 370 is attached to the metal layer 360 and a light-shielding layer 340. This construction strongly adheres the metal layer 360 to the top layer 310 of the image forming substrate 300.

In one embodiment, each electron collector or metal member 370 has first and second ends wherein the first end is attached to the image forming substrate 300 and the second end faces the electron emission substrate 200. Each electron collector or metal member 370 extends a predetermined distance toward the electron emission substrate 200. The second end of each electron collector or metal member may have a width larger than a width of the first end of the electron collector or metal member, as shown in FIGS. 3G and 4. Also, the electron collector or metal member has a middle width narrower than the width of the second end. The electron collector or metal member 370 and the metal layer 360 are energized by the same exterior voltage. The electron collector or metal member 370 may comprise any suitable material, such as metal, and may comprise the same material as the metal layer 360.

After forming the image forming substrate and electron emission substrate, the electron emission display is hermetically sealed to create a vacuum. Then, an external power source is used to apply a positive voltage to the cathode electrode 220, a negative voltage to the gate electrode 240, and a positive voltage to the anode electrode 320. The voltage difference between the cathode electrodes 220 and the gate electrodes 240 creates an electric field around the electron emission devices 250. This electric field causes the electron emission devices 250 to emit electrons. A high voltage applied to the anode electrode 320 then causes the emitted electrons to collide with the fluorescent layers 330 corresponding to the pixels at which the electron emission devices 250 are located. The collision of electrons with the fluorescent layers 330 emits light, thereby displaying a predetermined image.

FIGS. 3A through 3G illustrate various steps in a method of fabricating an image forming substrate according to one embodiment of the present invention. Referring to FIGS. 3A through 3G, a method of forming an image forming substrate 300 according to one embodiment of the present invention comprises first forming at least one fluorescent layer 330 on a top layer 310, and then forming at least one intermediate layer 350 on the fluorescent layer 330. A metal layer 360 is positioned on the intermediate layers 350 and the intermediate layers 350 are then removed. At least one electron collector or metal member 370 is then formed on the metal layer 360.

Figure 3A:
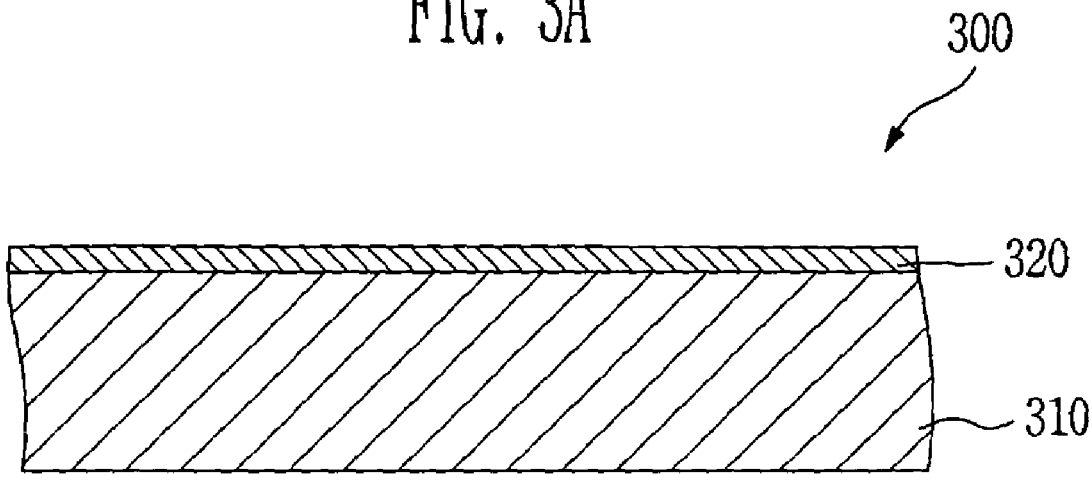
FIG. 3A is a cross-sectional view of a representative portion of an image forming substrate of the electron emission device of FIG. 2, illustrating a first step in a process for fabricating the image forming substrate according to one embodiment of the present invention.
Figure 3B:
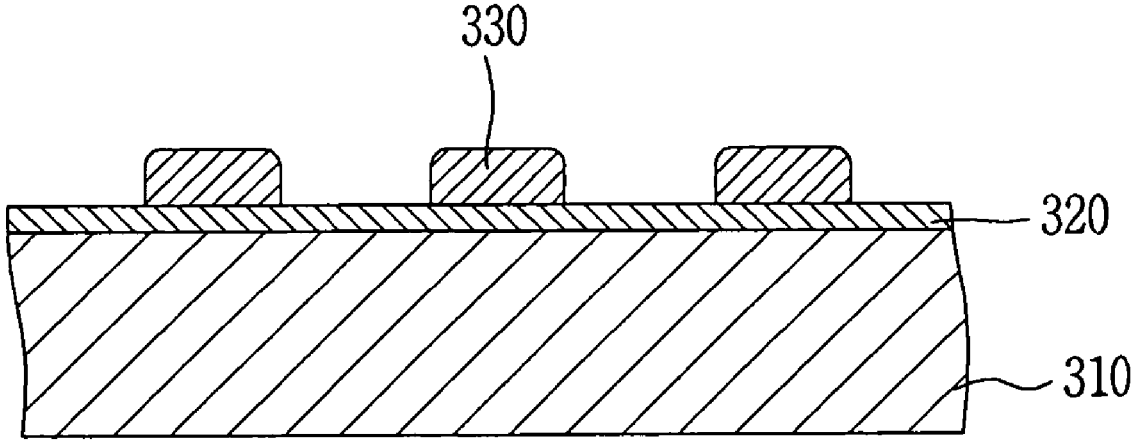
FIG. 3B is a cross-sectional view of a representative portion of the image forming substrate of FIG. 3A, illustrating a second step in the process for fabricating the image forming substrate.

Specifically, an anode electrode 320 is first formed on the top layer 310, as shown in FIG. 3A. The anode electrode 320 may comprise ITO, which is a transparent material, and the anode is sometimes referred to as an "ITO electrode." The fluorescent layers 330 are then positioned on the anode electrode 320, as shown in FIG. 3B. The fluorescent layers 330 may be deposited on the anode electrode by any suitable method, for example by slurry deposition, screen printing, electrophoresis (EL), or transfer.

Figure 3C:
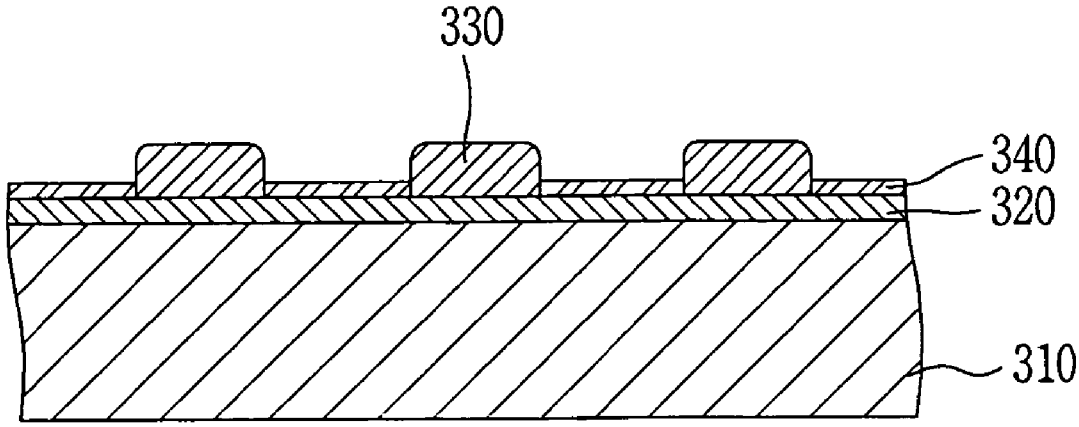
FIG. 3C is a cross-sectional view of a representative portion of the image forming substrate of FIG. 3B, illustrating a third step in the process for fabricating the image forming substrate.

Light-shielding layers 340 are then positioned on the anode electrode 320 between the fluorescent layers 330, as shown in FIG. 3C. The light-shielding layers 340 may be deposited by any suitable means, for example by sputtering and patterning a metal material, such as Cr onto the ITO electrode. The metal material, for example Cr, is then oxidized into a metal oxide, such as black chromium oxide ("CrOx"). Alternatively, the light-shielding layers 340 may be deposited by pattern printing a photosensitive paste of black Fodel® or Ag Fodel®).

Figure 3D:
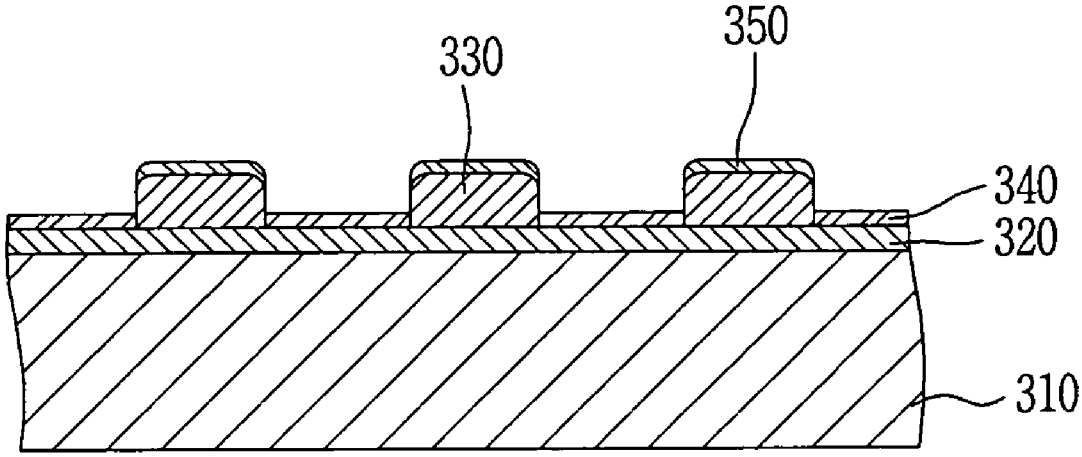
FIG. 3D is a cross-sectional view of a representative portion of the image forming substrate of FIG. 3C, illustrating a fourth step in the process for fabricating the image forming substrate.

After deposition of the light-shielding layers 340, a solution comprising a binder resin dissolved in a solvent is applied to the fluorescent layers 330 and dried to form intermediate layers 350, as shown in FIG. 3D. The intermediate layers 350 create planar surfaces on the fluorescent layers 330 and space the fluorescent layers 330 from the metal layer 360. In addition, the intermediate layers 350 minimize the formation of small holes in the fluorescent layers 330 which may otherwise form during deposition of the metal layer 360. Therefore, the intermediate layers 350 increase the brightness of the display.

Figure 3E:
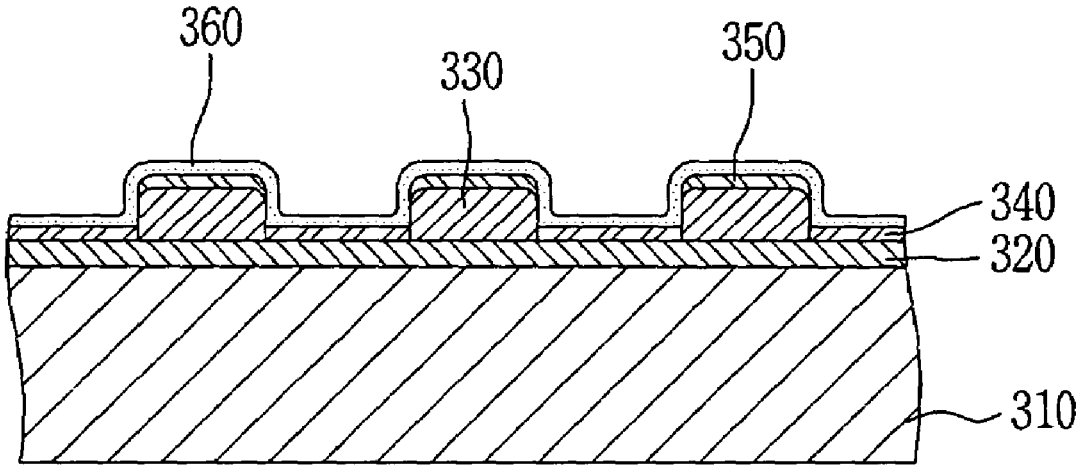
FIG. 3E is a cross-sectional view of a representative portion of the image forming substrate of FIG. 3D, illustrating a fifth step in the process for fabricating the image forming substrate.

The metal layer 360 is then deposited on the intermediate layers 350, as shown in FIG. 3E. In one embodiment, the metal layer 360 comprises aluminum. The aluminum metal layer 350 improves brightness and color reproduction of the fluorescent layers 330 because aluminum can be deposited in a thin layer by sputtering. Also, aluminum improves the brightness of the fluorescent layers 330 by reflecting scattered electrons toward the fluorescent layers 330.

Figure 3F:
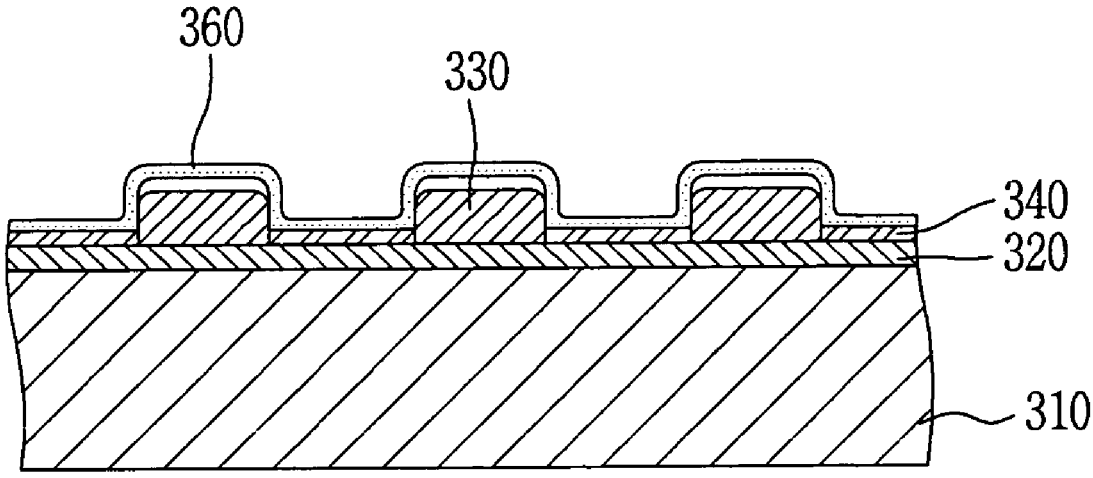
FIG. 3F is a cross-sectional view of a representative portion of the image forming substrate of FIG. 3E, illustrating a sixth step in the process for fabricating the image forming substrate.
Figure 3G:
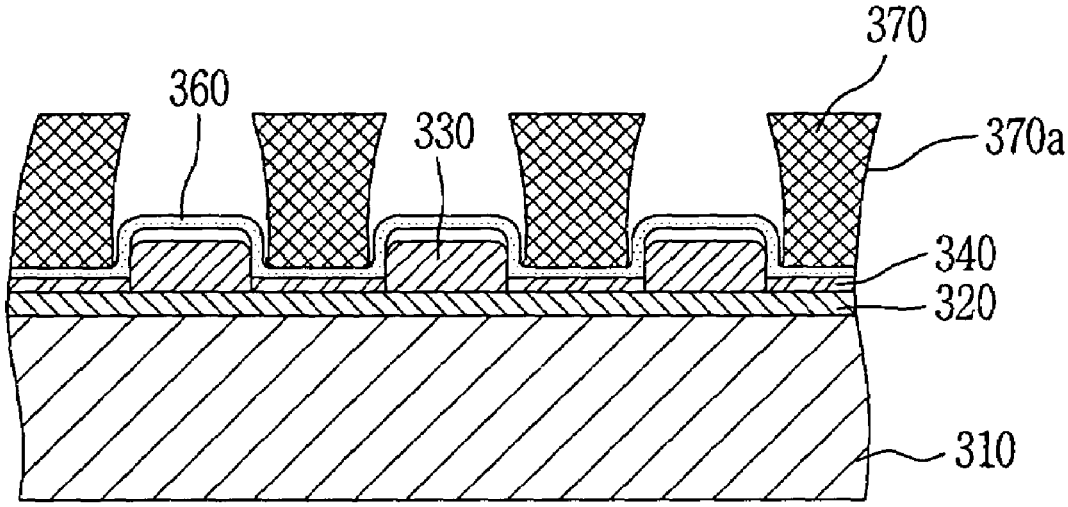
FIG. 3G is a cross-sectional view of a representative portion of the image forming substrate of FIG. 3F, illustrating a seventh step in the process for fabricating the image forming substrate.

After deposition of the metal layer 360, the intermediate layers 350 are dissolved, leaving spaces between the fluorescent layers 330 and the metal layer 360, as shown in FIG. 3F.

Finally, at least one electron collector or metal member 370 is positioned on the metal layer 360. In embodiments using light-shielding layers 340, the electron collectors or metal members 370 are positioned on the metal layer 370 over the light-shielding layers 340. This construction stabilizes the structure of the metal layer. The electron collectors or metal members 370 may each comprise first and second ends, wherein the first end is attached to the image forming substrate and the second end faces the electron emission substrate. The electron collectors or metal members 370 each extend a predetermined distance of about 5 to about 200 μm toward the electron emission substrate 200. In one embodiment, the second end of each electron collector or metal member 370 has a width larger than a width of the first end, as shown in FIG. 3G. Each electron collector or metal member 370 may comprise a reflective metal material, such as Al, Ag and the like. The electron collectors or metal members 370 are adhered to the metal layer by frit or the like.

Figure 4:
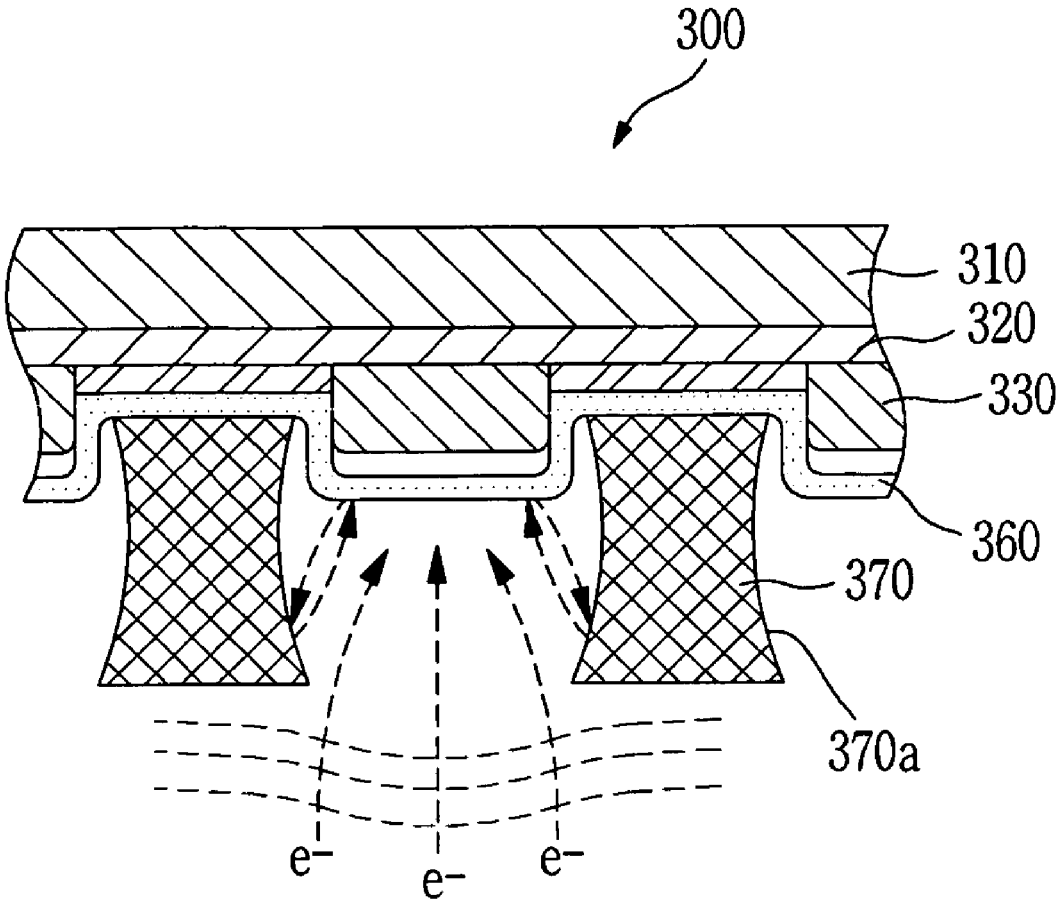
FIG. 4 is a close-up cross-sectional view of region A of the image forming substrate of FIG. 2.

FIG. 4 is a close up view of region A of FIG. 2. Referring to FIG. 4, the electron collector or metal member 370 is positioned on the metal layer 360 and presses the metal layer 360 toward the fluorescent layers 330 and the top layer 310. As a result, any gaps between the metal layer 360 and the fluorescent layers 330 are lessened. In use, the same voltage is applied to the electron collector or metal member 370 and the metal layer 360, thereby creating an electric field between adjacent electron collectors or metal members 370, as shown in dotted lines in FIG. 4.

The electron collectors or metal members 370 enable the fluorescent layers 330 to more completely collect electrons ($e^-$) emitted from the electron emission devices 250. The electron collectors or metal members 370 reflect the light emitted by the collision of electrons with the fluorescent layers 330. The light is reflected through the metal layer 360 to the top layer 310. In addition, each electron collector or metal member 370 comprises first and second ends wherein the second end has a width larger than a width of the first end. This construction enables the electron collectors or metal members 370 to collect the electrons emitted from the cathode electrodes in a central region, and to re-direct the scattered electrons toward the fluorescent layers 330. Scattered electrons collide with the surfaces 370*a* of the electron collector or metal member 370 and are thereby re-directed toward the fluorescent layers 330.

Figure 5:
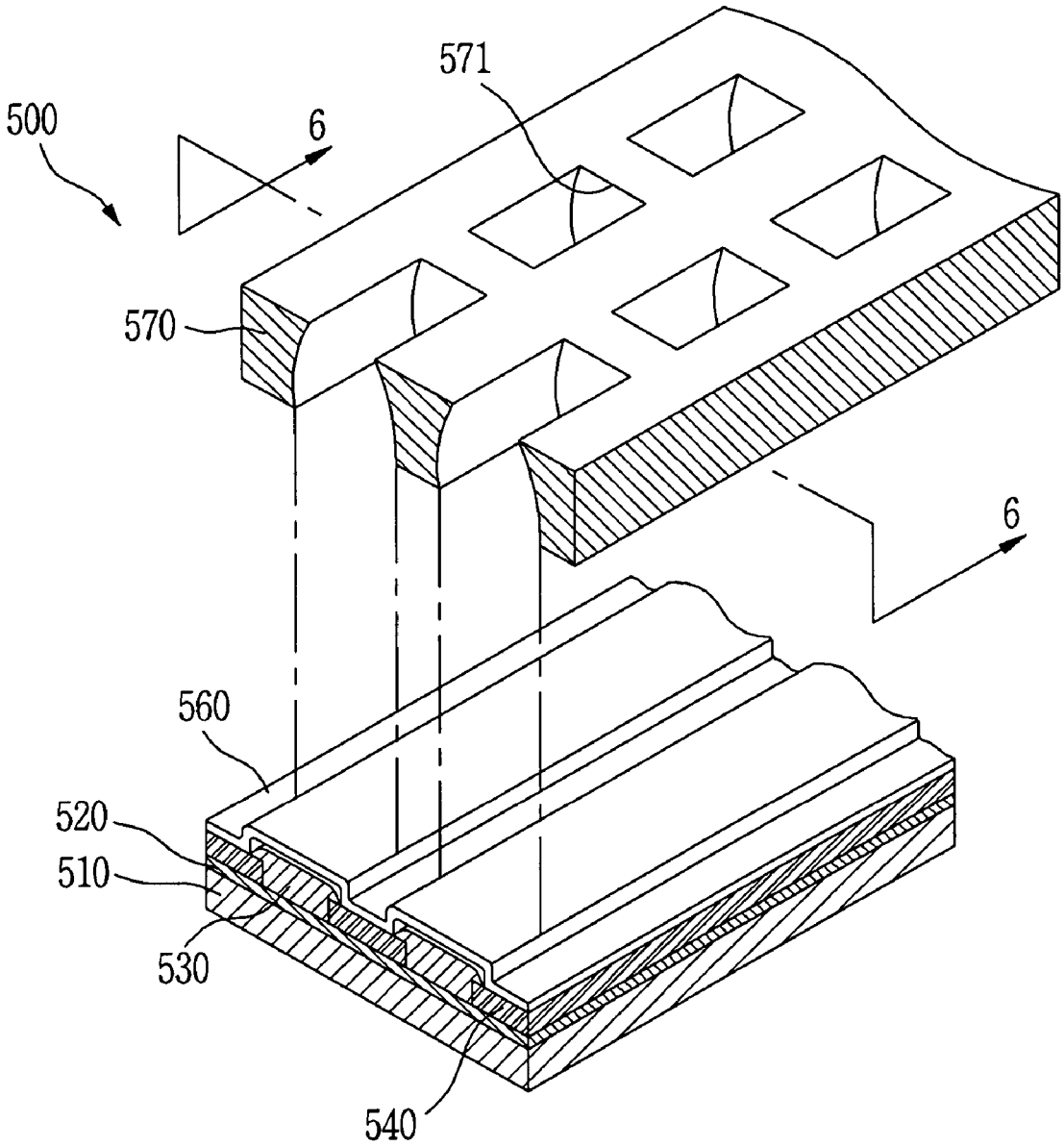
FIG. 5 is a schematic perspective view of a representative section of an image forming substrate according to an alternative embodiment of the present invention.
Figure 6:
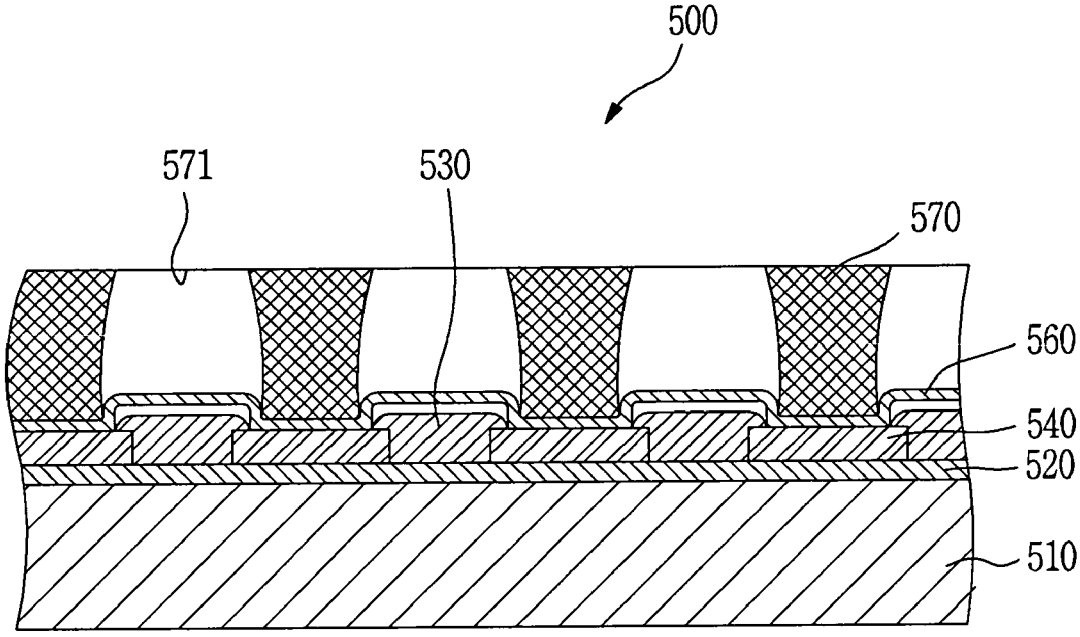
FIG. 6 is a side cross-sectional view of the image forming substrate of FIG. 5, taken along line 6-6.
Figure 7:
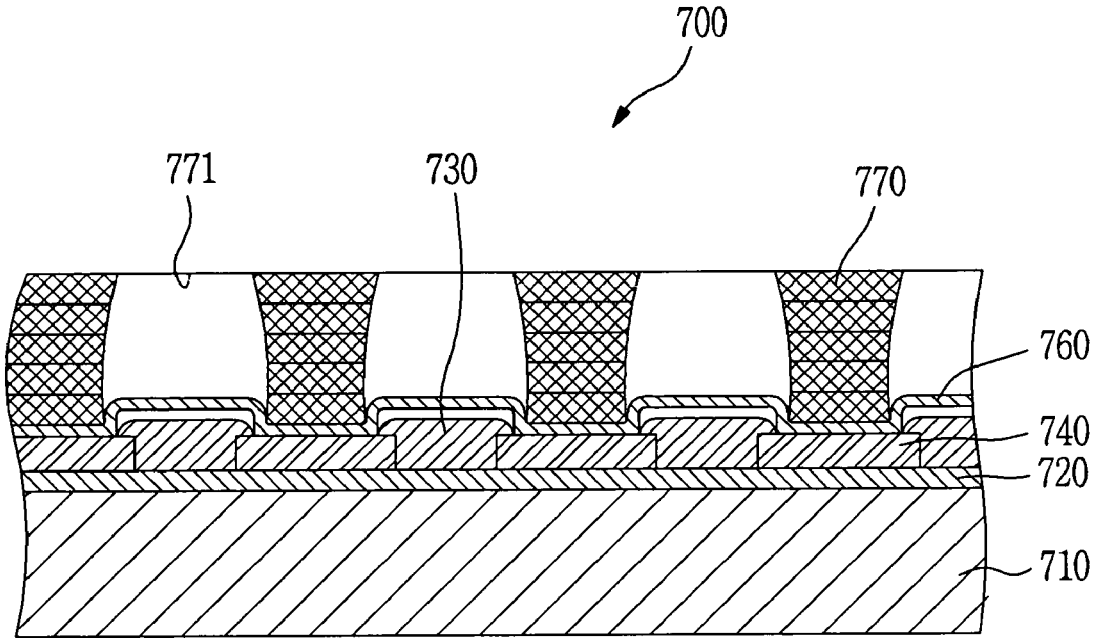
FIG. 7 is a side cross-sectional view of an image forming substrate of an electron emission display according to yet another embodiment of the present invention.

FIG. 5 is a schematic perspective view of a representative section of an image forming substrate according to an alternative embodiment of the present invention. FIG. 6 is a side cross-sectional view of the image forming substrate of FIG. 5, taken along line 6-6. FIG. 7 is a side cross-sectional view of an image forming substrate according to yet another embodiment of the present invention.

Referring to FIGS. 5 and 6, an image forming substrate 500 comprises a top layer 510, an anode electrode 520 positioned on the top layer 510, at least one fluorescent layer 530 positioned on the anode electrode 520, and a metal layer 560 positioned on the fluorescent layers 530. The image forming substrate 500 may also optionally comprise at least one light-shielding layer 540 positioned on the anode electrode 520. In addition, an electron collector 570 comprising a metal sheet is positioned on the metal layer 560. The components and operation of the image forming substrate 500 are largely similar to those of the image forming substrate 300, described in detail above with reference to FIG*s*. 2 through 4. Accordingly, only the differences between the image forming substrate 500 and the image forming substrate 300 will now be described.

The electron collector or metal member 570 is positioned in a non-emission region of the image forming substrate 500 in which no fluorescent layers 530 are positioned. The electron collector or metal member 570 is positioned on the metal layer 560 over the light-shielding layers 540. After deposition of the metal layer 560, the intermediate layers (not shown) are removed, creating spaces between the fluorescent layers 530 and the metal layer 560. As shown in FIGS. 5 and 6, the electron collector or metal member 570 comprises a single sheet. The sheet may have thickness of about 5 to about 200 μm.

The electron collector or metal member 570 comprises a plurality of openings 571 corresponding in position to the position of the fluorescent layers 530, i.e. the emission regions of the image forming substrate 500. In addition, the electron collector or metal member 570 is adhered to the metal layer 560 with an adhesive such as frit.

Similarly, in the embodiment illustrated in FIG. 7, an image forming substrate 700 comprises a top layer 710, an anode electrode 720 positioned on the top layer 710, at least one fluorescent layer 730 positioned on the anode electrode 720, and a metal layer 760 positioned on the fluorescent layers 730. The image forming substrate 700 may also optionally comprise at least one light-shielding layer 740 positioned on the anode electrode 720. In addition, an electron collector or metal member 770 comprising a metal sheet is positioned on the metal layer 760. The components and operation of the image forming substrate 700 are largely similar to those of the image forming substrate 300, described in detail above with reference to FIGS. 2 through 4. Accordingly, only the differences between the image forming substrate 700 and the image forming substrate 300 will now be described.

The electron collector or metal member 770 is positioned in a non-emission region of the image forming substrate 700 in which no fluorescent layers 730 are positioned. The electron collector or metal member 770 is positioned on the metal layer 760 over the light-shielding layers 740. After deposition of the metal layer 760, the intermediate layers (not shown) are removed, creating spaces between the fluorescent layers 730 and the metal layer 760. As shown in FIG. 7, the electron collector or metal member 770 comprises a multi-layered metal sheet, which may comprise a reflective metal material such as Al, Ag or the like. The sheet may have thickness of about 5 to about 200 μm.

The electron collectors or metal members 770 comprises a plurality of openings 771 corresponding in position to the position of the fluorescent layers 760, i.e. the emission regions of the image forming substrate 700. In addition, the electron collector or metal member 770 is adhered to the metal layer 760 with an adhesive such as frit.

While the image forming substrates described above each comprise an anode electrode on the top layer of the image forming substrate, it is understood that the metal layer can perform the same functions as the anode electrode. Therefore, the anode electrode may be omitted.

Figure 8A:
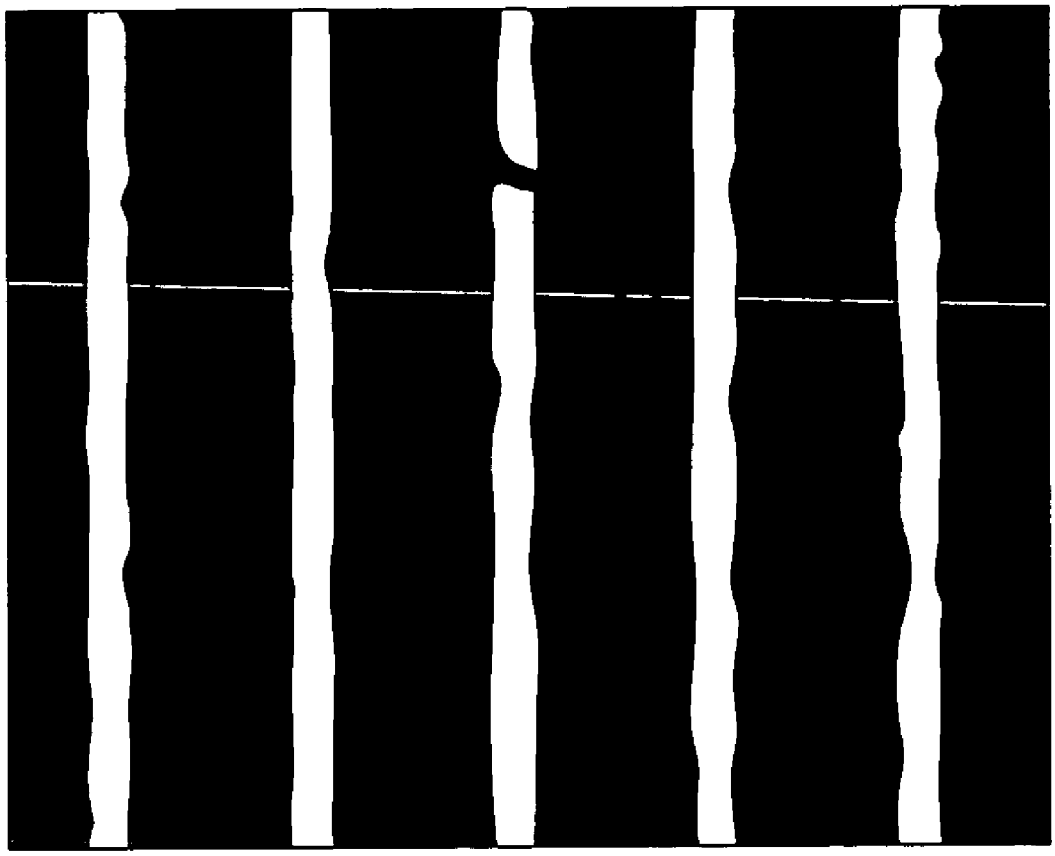
FIG. 8A (PRIOR ART)
FIG. 8A is an emission photograph of a green fluorescent layer of an electron emission display according to the prior art.
Figure 8B:
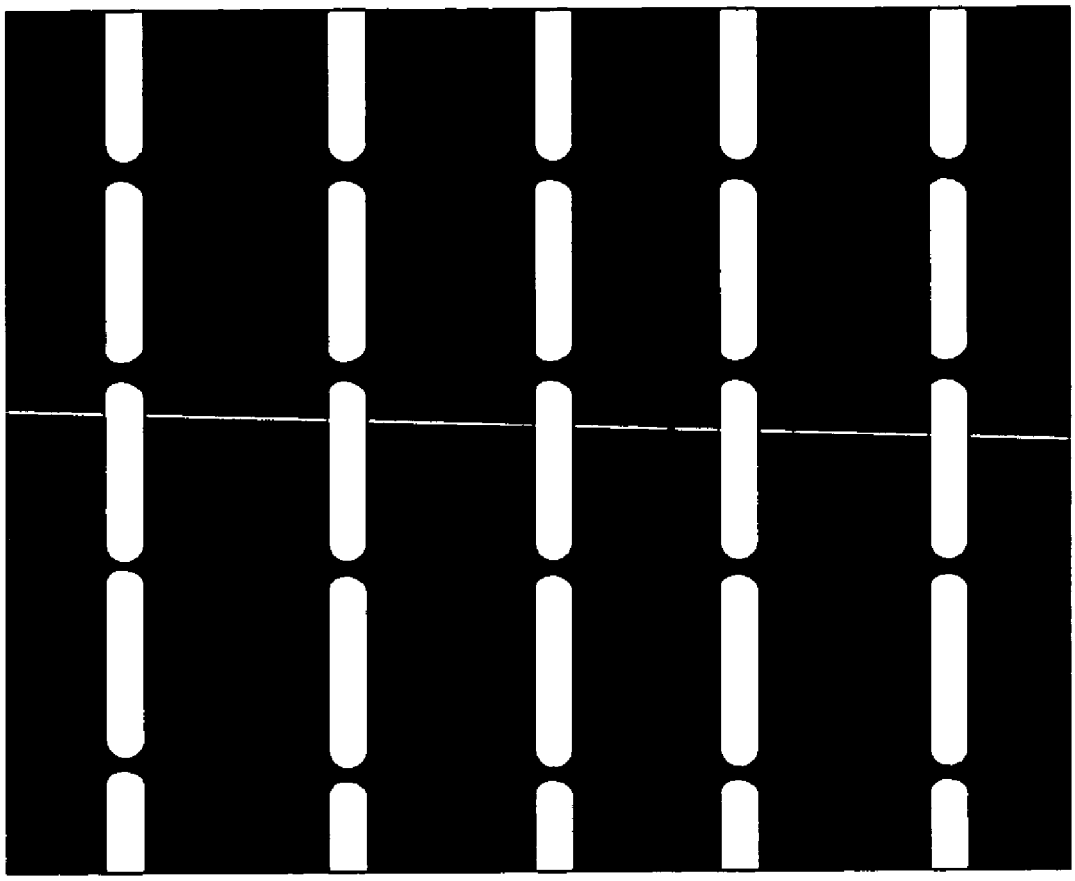
FIG. 8B is an emission photograph of a green fluorescent layer of an electron emission display according to one embodiment of the present invention.

FIG. 8A is an emission photograph of a green fluorescent layer of an electron emission display according to the prior art. FIG. 8B is an emission photograph of a green fluorescent layer of an electron emission display according to one embodiment of the present invention. As shown in FIG. 8A, electron emission displays without electron collectors or metal members on the image forming substrates experience interference between red or blue fluorescent layers that are adjacent to the green fluorescent layers. As a result, the color purity of the green fluorescent layers is reduced and brightness is not regularly maintained. In contrast, as shown in FIG. 8B, electron emission displays using electron collectors or metal members according to the present invention more effectively collect electrons. Accordingly, color purity of the fluorescent layers is improved and the brightness is regularly maintained.

Therefore, the electron emission displays according to the present invention more effectively collect the electrons emitted from the electron emission devices, thereby improving brightness, color reproduction, and color purity of the display.

In addition, the spaces between the fluorescent layers and the metal layer are reduced by the electron collectors or metal members positioned in the non-emission regions, thereby reducing arc formed by the voltage applied to the metal layer. In addition, the electron collectors or metal members used in the electron emission displays of the present invention improve luminous efficiency and enable maintenance of uniform brightness because the emitted electrons are more effectively collected.

Although the present invention has been described with reference to certain exemplary embodiments, it is understood by those skilled in the art that a variety of modifications and variations may be made without departing from the spirit and scope of the present invention as defined in the appended claims.

What is claimed is:

1. An electron emission display comprising:

an electron emission substrate comprising at least one electron emission device; and an image forming substrate comprising:

at least one fluorescent layer;

a metal layer positioned over the at least one fluorescent layer; and at least one electron collector positioned on the metal layer in at least one region of the image forming substrate where no fluorescent layers are positioned, the at least one electron collector being between the metal layer and the electron emission substrate and spaced apart from the electron emission substrate, wherein the at least one electron collector comprises a first collector end and a second collector end, the first collector end facing the metal layer of the image forming substrate, the second collector end facing the electron emission substrate, the second collector end having an outer parameter larger than that at the center of the at least one electron collector.

2. The electron emission display according to claim 1, wherein the metal layer covers an entire surface of the image forming substrate.

3. The electron emission display according to claim 1, wherein the electron collector extends a distance of about 5 to about 200 μm toward the electron emission substrate.

4. The electron emission display according to claim 1, wherein the electron collector comprises a reflective metal.

5. The electron emission display according to claim 4, wherein the reflective metal is selected from the group consisting of Al and Ag.

6. The electron emission display according to claim 1, wherein the metal layer comprises aluminum.

7. The electron emission display according to claim 1, wherein the electron collector is attached to the metal layer.

8. The electron emission display according to claim 7, wherein the electron collector is attached to the metal layer by frit.

9. The electron emission display according to claim 1, further comprising an anode electrode, wherein the fluorescent layer is positioned on the anode electrode.

10. The electron emission display according to claim 1, further comprising at least one light-shielding layer in the at least one region of the image forming substrate where no fluorescent layers are positioned, the metal layer being between the light-shielding layer and the electron collector.

11. An electron emission display comprising:

an electron emission substrate comprising at least one electron emission device; and an image forming substrate comprising:

at least one fluorescent layer;

a metal layer positioned over the at least one fluorescent layer; and an electron collector comprising a sheet, the electron collector being positioned on the metal layer and between the metal layer and the electron emission substrate, and comprising at least one opening corresponding in position to the position of the fluorescent layer, wherein the at least one opening has a first open end and a second open end, the first open end facing the fluorescent layer, the second open end facing the electron emission substrate, and wherein the middle of the at least one opening is wider than the second open end.

12. The electron emission display according to claim 11, wherein the electron collector comprises a single sheet.

13. The electron emission display according to claim 11, wherein the electron collector comprises a multi-layered sheet.

14. The electron emission display according to claim 11, wherein the electron collector comprises a thickness of about 5 to about 200 μm.

15. The electron emission display according to claim 11, wherein the electron collector comprises a reflective metal.

16. The electron emission display according to claim 11, further comprising an anode electrode, wherein the fluorescent layer is positioned on the anode electrode.

17. The electron emission display according to claim 11, further comprising at least one light-shielding layer in at least one region of the image forming substrate where no fluorescent layers are positioned, the metal layer being between the at least one light-shielding layer and the electron collector.

18. A method of manufacturing an image forming substrate for an electron emission display, the method comprising:

positioning at least one fluorescent layer on a first layer;

positioning at least one intermediate layer on each fluorescent layer;

positioning a metal layer over at least the intermediate layer;

removing the intermediate layer;

forming at least one electron collector to comprise a first collector end and a second collector end, the first collector end being for facing the metal layer of the image forming substrate, the second collector end being for facing the electron emission substrate, the second collector end having an outer parameter larger than that at the center of the at least one electron collector; and positioning the at least one electron collector on the metal layer.

19. The method according to claim 18, further comprising positioning at least one light-shielding layer on the first layer, wherein the light shielding layer is positioned on the first layer in a region of the first layer where no fluorescent layer is positioned.

20. The method according to claim 18, further comprising positioning an anode electrode on the first layer, wherein the fluorescent layers are positioned on the anode electrode.

21. An electron emission display comprising:

an electron emission substrate comprising at least one electron emission device; and an image forming substrate comprising:

at least one fluorescent layer;

a metal layer positioned over the at least one fluorescent layer; and at least one metal member positioned on the metal layer in at least one region of the image forming substrate where no fluorescent layers are positioned, the at least one metal member being between the metal layer and the electron emission substrate and spaced apart from the electron emission substrate, wherein the at least one metal member comprises a first metal end and a second metal end, the first metal end facing the metal layer of the image forming substrate, the second metal end facing the electron emission substrate, the second metal end having an outer parameter larger than that at the center of the at least one metal member.

22. The electron emission display according to claim 1, wherein metal layer is positioned over the fluorescent layer with a space between the fluorescent layer and the metal layer to reflect light emitted by the fluorescent layer back toward the fluorescent layer.

23. The electron emission display according to claim 1, wherein the electron collector has an outer surface for redirecting scatter electrons toward the fluorescent layer, the outer surface being between the first collector end and the second collector end.

24. The electron emission display according to claim 23, wherein the outer surface has a first outer surface facing the electron emission substrate and a second outer surface facing the fluorescent layer.

25. The electron emission display according to claim 24, wherein the first outer surface is between the first collector end and the center of the electron collector, and the second outer surface is between the center of the electron collector and the second collector end.

* * * * *